US009562503B2

(12) United States Patent
Hijima et al.

(10) Patent No.: US 9,562,503 B2
(45) Date of Patent: Feb. 7, 2017

(54) FUEL INJECTION NOZZLE

(71) Applicant: DENSO CORPORATION, Kariya, Aichi-pref. (JP)

(72) Inventors: Toshiaki Hijima, Nishio (JP); Fumiaki Arikawa, Okazaki (JP); Motoya Kanbara, Nishio (JP); Yuuta Hashimoto, Nishio (JP); Atsushi Utsunomiya, Kitanagoya (JP); Kazufumi Serizawa, Obu (JP); Shinya Sano, Anjo (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/600,410

(22) Filed: Jan. 20, 2015

(65) Prior Publication Data

US 2015/0211460 A1 Jul. 30, 2015

(30) Foreign Application Priority Data

Jan. 30, 2014 (JP) ..... 2014-15011

(51) Int. Cl.
*B05B 1/30* (2006.01)
*F02M 61/10* (2006.01)
*F02M 61/18* (2006.01)

(52) U.S. Cl.
CPC ..... *F02M 61/10* (2013.01); *F02M 61/18* (2013.01)

(58) Field of Classification Search
CPC ..... F02M 61/10
USPC ..... 239/584
See application file for complete search history.

(56) References Cited

U.S. PATENT DOCUMENTS 2,708,601 A * 5/1955 Links ..... F02M 61/06 123/294
3,035,780 A * 5/1962 Peras ..... F02M 61/06 239/453
3,175,771 A * 3/1965 Breting ..... F02M 61/06 239/453
3,980,237 A * 9/1976 Parrish, Jr. ..... F02M 61/18 239/533.3
7,438,238 B2 * 10/2008 Date ..... F02M 43/04 123/304
7,510,129 B2 * 3/2009 Kuronita ..... F02M 61/182 239/556

(Continued)

FOREIGN PATENT DOCUMENTS

JP 8-144895 6/1996
JP 9-137764 5/1997

(Continued)

*Primary Examiner* — Arthur O Hall
*Assistant Examiner* — Adam J Rogers
(74) *Attorney, Agent, or Firm* — Nixon & Vanderhye, P.C.

(57) ABSTRACT

In a nozzle, in a cross section including an axis of a nozzle body, a side surface and a seat surface are both smoothly connected to an arc of a circle inscribing both the side surface and the seat surface. A part of a needle which is adjacent to a tip end side of a seat portion is a cone having a diameter reduced toward a tip end side of the cone in the axial direction. Thus, no corner is on the seat surface or the side surface, and the two surfaces form one curved surface. Since a cavitation generated in a sack chamber can be reduced, even when an injection quantity is significantly small such that an injection port does not throttle an injection flow, a flow coefficient of the injection flow is improved and a penetration of a spray of the fuel can be maintained.

13 Claims, 9 Drawing Sheets

(56) References Cited

U.S. PATENT DOCUMENTS

| | | | | |
|---|---|---|---|---|
| 8,544,770 | B2 * | 10/2013 | Limmer | F02M 61/1806 123/525 |
| 2005/0161536 | A1 * | 7/2005 | Tojo | F02M 61/16 239/584 |
| 2006/0249600 | A1 | 11/2006 | Sako et al. | |
| 2009/0242670 | A1 * | 10/2009 | Kato | F02M 51/0671 239/584 |
| 2012/0152205 | A1 * | 6/2012 | Matsumura | F02M 61/184 123/445 |
| 2013/0270369 | A1 * | 10/2013 | Peters | F02M 61/1866 239/533.2 |

FOREIGN PATENT DOCUMENTS

| | | |
|---|---|---|
| JP | 2008-138610 | 6/2008 |
| JP | 2010-174819 | 8/2010 |

* cited by examiner

FUEL INJECTION NOZZLE

CROSS REFERENCE TO RELATED APPLICATION

This application is based on Japanese Patent Application No. 2014-15011 filed on Jan. 30, 2014, the disclosure of which is incorporated herein by reference.

TECHNICAL FIELD

The present disclosure relates to a fuel injection nozzle injecting a fuel.

BACKGROUND

Conventionally, a fuel injector supplying and injecting a fuel to an internal combustion engine includes a nozzle which injects the fuel and an actuator which drives to open or close the nozzle. The nozzle (fuel injection nozzle) used in the fuel injector includes a nozzle body which is a cylindrical shape and a needle which is received in the nozzle body and is slidable relative to an inner periphery of the nozzle body. In the nozzle, the inner periphery of the nozzle body includes a seat surface, and an injection port is placed at a tip end side of the seat surface in an axial direction of the nozzle body. The needle includes a seat portion which is removed from or seated on the seat surface to start or stop a fuel injection using the injection port.

However, in a fuel injector in which a fuel with high pressure is directly injected into a cylinder of a diesel engine, a request of an emission reduction is high. Therefore, as an aspect of the emission reduction, it is considered that a penetration of a spray of the fuel is maintained to reduce a smoke generation even though a lifting amount of the needle is small and an injection quantity is significantly small.

According to JP-H08-144895A, since a center diameter of a needle is greater than an inner diameter of a sack portion, a spray can be properly generated and a non-combustion gas can be reduced. However, when a lifting amount is small before a throttle portion of a flow of a fuel becomes an injection port in a nozzle, a flow-passage area is sharply enlarged toward downstream from a position where a diameter of the needle is the center diameter. Therefore, when the lifting amount is small, a cavitation is generated in the sack chamber such that a flow coefficient is deteriorated, and the penetration of the spray is decreased such that a smoke is readily generated.

SUMMARY

The present disclosure is made in view of the above matters, and it is an object of the present disclosure to provide a fuel injection nozzle in which a deterioration of a flow coefficient is restrained to maintain a penetration of a spray even when a lifting amount is small such that an injection quantity is significantly small.

According to an aspect of the present disclosure, the fuel injection nozzle includes a nozzle body which is a cylindrical shape and a needle which is received in the nozzle body and is slidable relative to an inner periphery of the nozzle body in an axial direction of the nozzle body. The inner periphery of the nozzle body includes a seat surface, and the needle includes a seat portion. The seat portion is removed from or seated on the seat surface to start or stop a fuel injection using an injection port disposed at a tip end side of the seat surface in the axial direction.

The seat surface is a tapered shape. A diameter of the seat surface is reduced toward the tip end side of the seat surface in the axial direction. A sack chamber is disposed at a position adjacent to the tip end side of the seat surface and includes an inlet of the injection port. The side surface has a sharper slope than the seat surface and is coaxial with the seat surface. The bottom surface is a curved shape and covers the sack chamber at a tip end side of the side surface in the axial direction. The side surface and the bottom surface are smoothly connected to each other.

In a cross section including an axis of the nozzle body, the side surface and the seat surface are both smoothly connected to an arc of a circle inscribing both the side surface and the seat surface. A part of the needle which is adjacent to a tip end side of the seat portion is a cone having a diameter reduced toward a tip end side of the cone in the axial direction.

Thus, there is no corner on the seat surface or the side surface, and the seat surface and the side surface form one curved surface. Therefore, a generation of a separation of the injection flow of the fuel from the gap interposed between the seat surface and the seat portion to the outlet is reduced. Further, a portion that a flow-passage area of the fuel from the gap to the inlet is sharply enlarged does not exist. Since a cavitation generated in the sack chamber can be reduced, even when an injection quantity is significantly small such that the injection port does not throttle the injection flow, that is, even when the lifting amount is a significantly small value, a flow coefficient of the injection flow is improved and a penetration of a spray of the fuel can be maintained.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
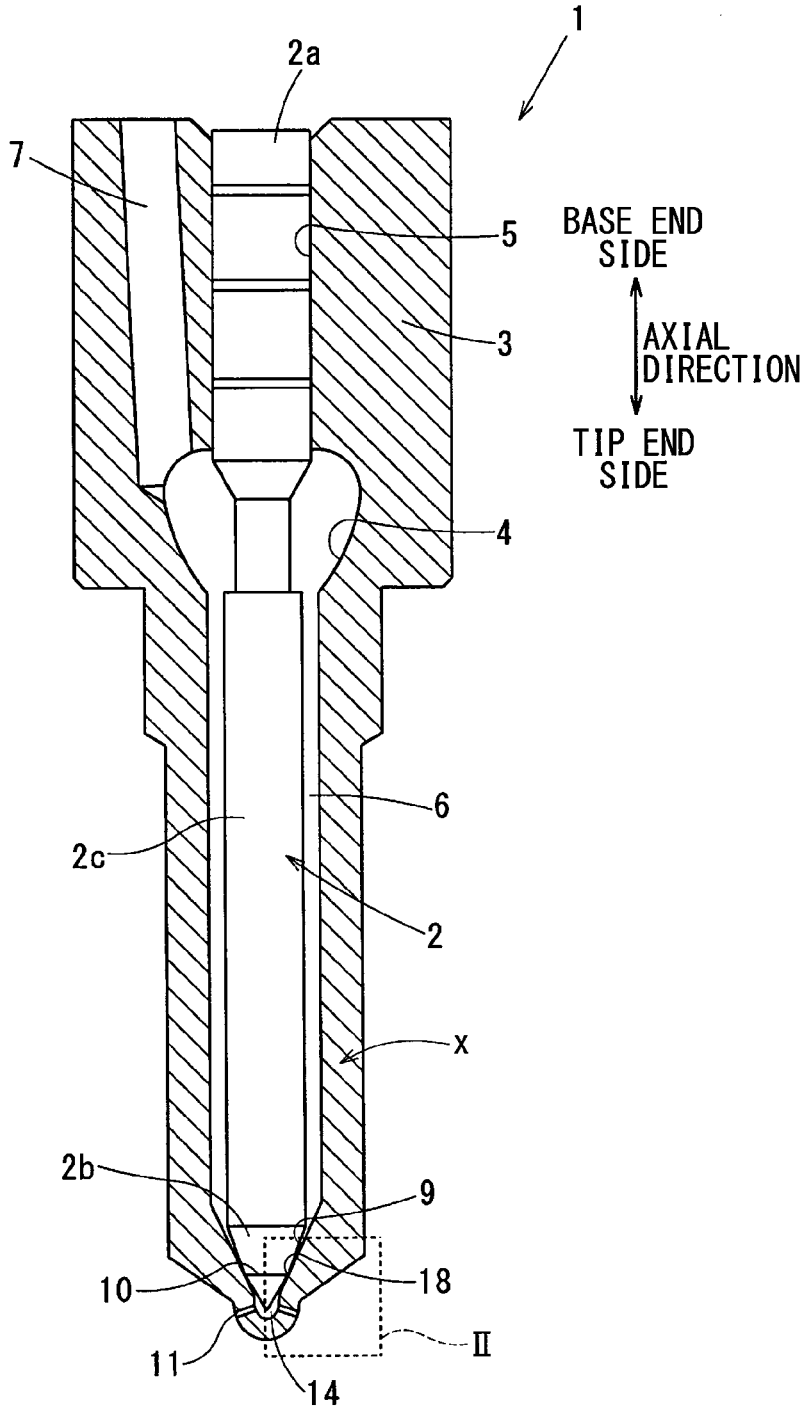
FIG. 1 is a diagram showing an outline of a fuel injection nozzle according to a first embodiment of the present disclosure.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

[First Embodiment]

According to a first embodiment of the present disclosure, a fuel injection nozzle opens to inject a fuel. Hereafter, the fuel injection nozzle is referred to as a nozzle 1. The nozzle 1 and an actuator (not shown) driving the nozzle 1 to open or close correspond to a fuel injector. The fuel injector is mounted to an internal combustion engine (not shown) for example, so as to directly inject a high-pressure fuel into a cylinder of the internal combustion engine. The high-pressure fuel has a pressure exceeding 100 MPa.

The actuator controls a back pressure applied to a valve body of the nozzle 1 to drive the valve body. According to the present embodiment, the valve body is a needle 2. The actuator controls the back pressure by opening or closing a back-pressure chamber (not shown) by using a magnetic force generated by an energization of a coil (not shown).

The fuel injector, a feed pump (not shown) which pressurizes and discharges the fuel, and an accumulator (not shown) which stores the fuel discharged from the feed pump correspond to a fuel supplying apparatus. In the fuel supplying apparatus, the fuel is distributed from the accumulator to cylinders.

As shown in FIG. 1, the nozzle 1 includes a nozzle body 3 having a cylindrical shape, the needle 2 housed in the nozzle body 3. The needle 2 is slidable relative to an inner periphery of the nozzle body 3 in an axial direction of the nozzle body 3. The nozzle 1 starts or stops a fuel injection by sliding the needle 2 relative to the inner periphery of the nozzle body 3 in the axial direction of the nozzle body 3.

The needle 2 includes a slidable shaft portion 2*a* which is slidably supported by the nozzle body 3 in the axial direction of the nozzle body 3, an end portion 2*b* which is a conical shape and substantially functions as the valve body, and a columnar portion 2*c* which is disposed between the slidable shaft portion 2*a* and the end portion 2*b*.

The inner periphery of the nozzle body 3 is an elongated tubular shape and has an end portion that is closed. Further, the inner periphery of the nozzle body 3 has a part that is enlarged in a radial direction of the nozzle body 3. In this case, the part temporarily storing the fuel to be injected is referred to as a fuel storage 4.

A sliding hole 5 slidably supporting the slidable shaft portion 2*a* is formed by an area of the inner periphery of the nozzle body 3 which is adjacent to a base end side of the fuel storage 4 in the axial direction. A first fuel passage 6 which is a circular-ring tubular shape and receives the end portion 2*b* and the columnar portion 2*c* is formed by an area of the inner periphery of the nozzle body 3 which is adjacent to a tip end side of the fuel storage 4 in the axial direction. The nozzle body 3 further includes a second fuel passage 7 connected to the fuel storage to introduce the fuel received from the accumulator to the fuel storage 4.

Figure 2:
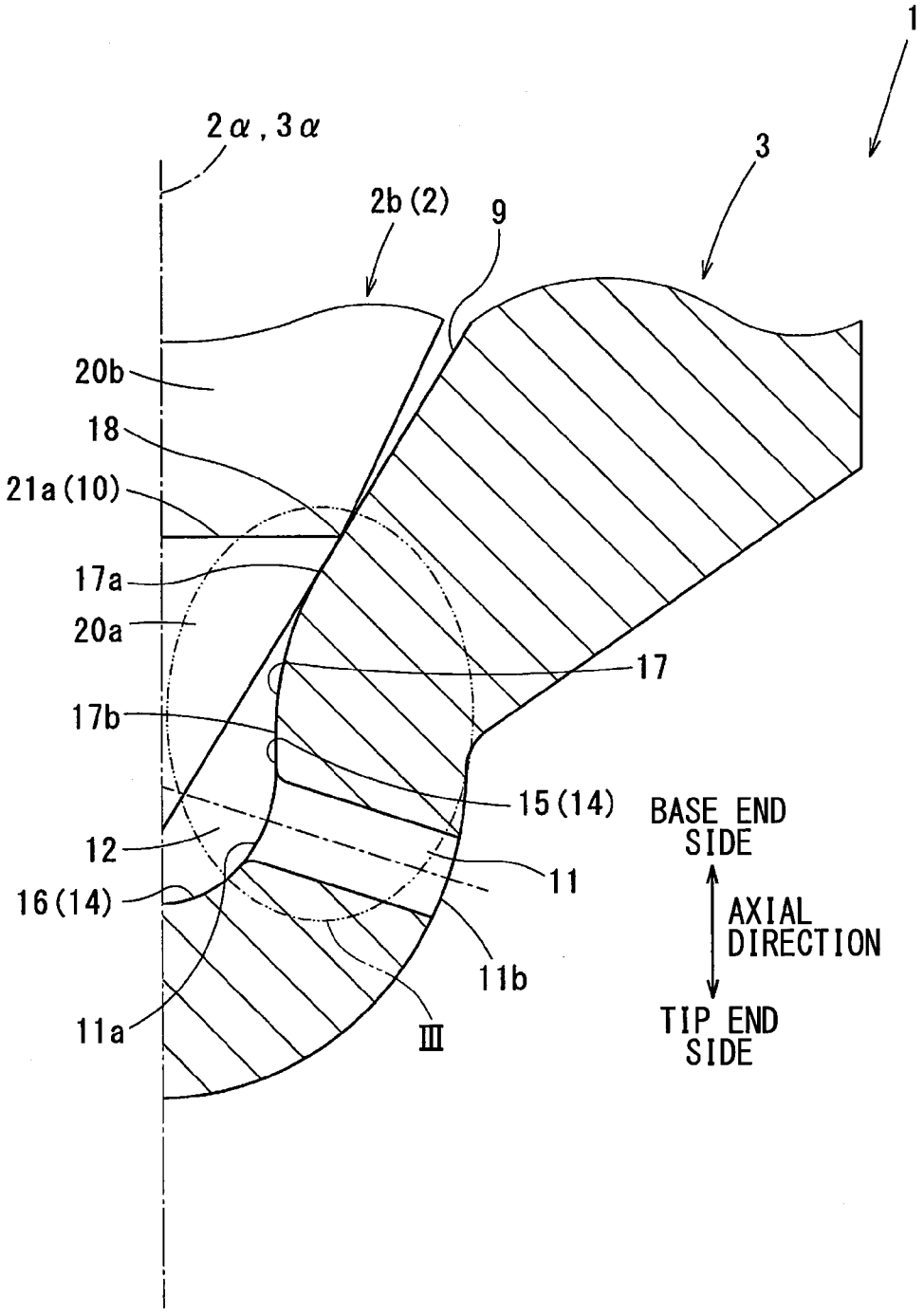
FIG. 2 is an enlarged view of an area II of FIG. 1.
Figure 3:
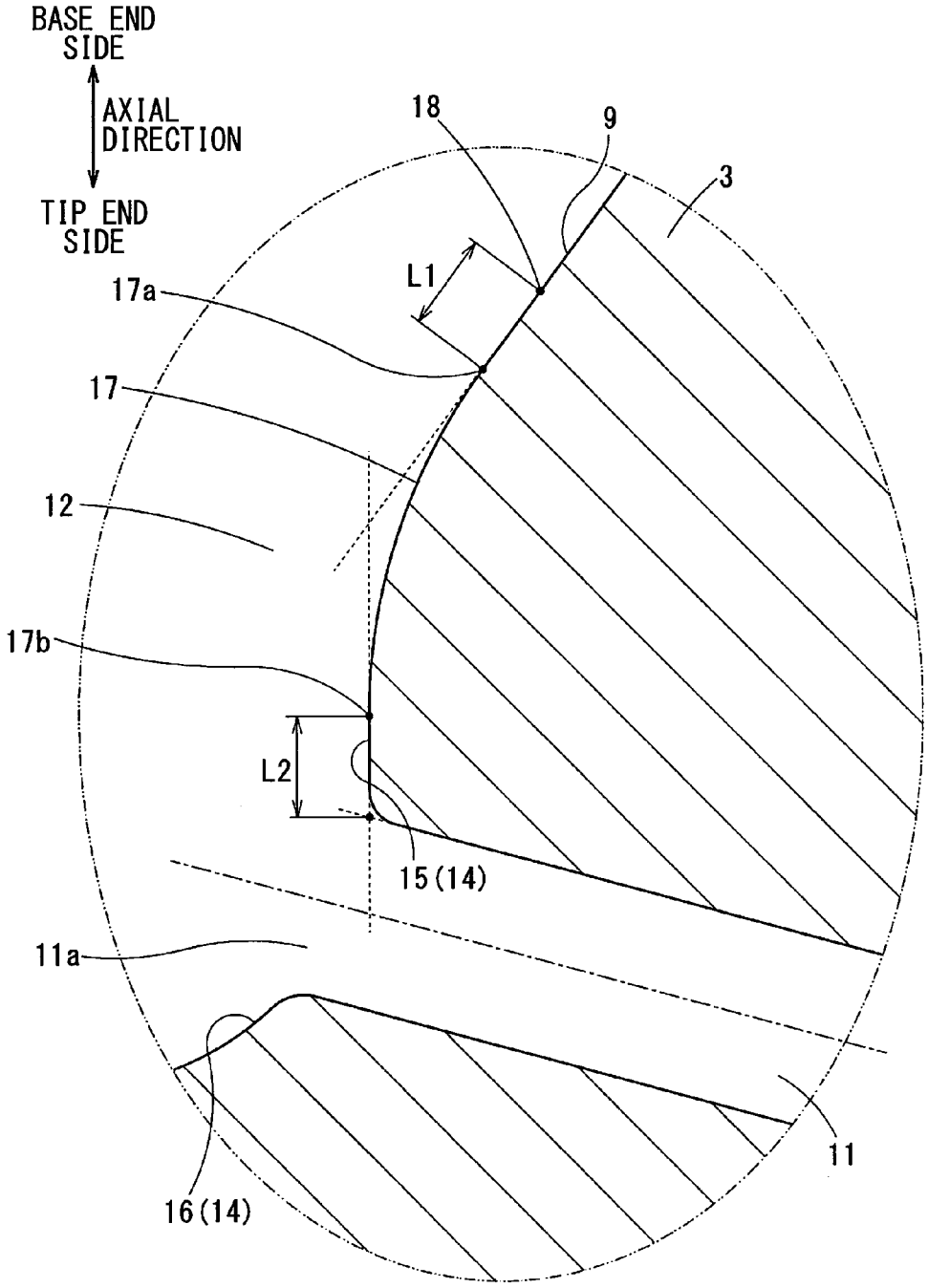
FIG. 3 is an enlarged view of an area III of FIG. 2.

Referring to FIGS. 2 and 4, the nozzle 1 will be described.

The nozzle 1 starts or stops the fuel injection by making a seat portion 10 of the needle 2 be removed from or be seated on a seat surface 9 on the inner periphery of the nozzle body 3. The fuel injection is executed by an injection port 11 disposed at a position of a tip end side of the seat surface 9 in the axial direction. Since the actuator drives the needle, the seat portion 10 is removed from or is seated on the seat surface 9.

The seat surface 9 is a tapered shape, and a diameter of the seat surface 9 is reduced toward the tip end side of the seat surface 9 in the axial direction. A sack chamber 12 is disposed at a position adjacent to the tip end side of the seat surface 9, and includes an inlet 11*a* of the injection port 11. The inlet 11*a* is referred to as an injection-port inlet 11*a*. An inner wall surface forming the sack chamber 12 includes a side surface 15 and a bottom surface 16. In this case, the inner wall surface is referred to as a sack surface 14. The side surface 15 is a surface having a sharper slope than the seat surface 9 and is coaxial with the seat surface 9. The bottom surface 16 is a curved shape that covers the sack chamber 12 at a tip end side of the side surface 15 in the axial direction. Further, the side surface 15 and the bottom surface 16 are smoothly connected to each other. The injection-port inlet 11*a* is provided to span the side surface 15 and the bottom surface 16. The side surface 15 is a cylindrical surface, and the bottom surface 16 is a hemisphere surface that protrudes toward the tip end side in the axial direction.

In a cross section x including an axis 3*a* of the nozzle body 3, the seat surface 9 and the side surface 15 are both smoothly connected to an arc of a circle inscribing both the seat surface 9 and the side surface 15. The inner periphery of the nozzle body 3 includes a sack portion 17 that is the arc in the cross section x. A first distance L1 between a seat position 18 where the seat portion 10 is seated on the seat surface 9 and an upstream end 17*a* of the sack portion 17 is established to satisfy a strength request. A second distance L2 between a downstream end 17*b* of the sack portion 17 and the injection-port inlet 11*a* is set to a value greater than or equal to 0.2 mm in a view of reducing a cavitation generated in the injection port 11.

The seat portion 10 is arranged in the end portion 2*b* of the needle 2. An outer-peripheral surface of the end portion 2*b* includes a first conical surface 20*a* and a second conical surface 20*b* which are coaxial with each other. The first conical surface 20*a* is placed at a position of a tip end side of the second conical surface 20*b* and is connected with the second conical surface 20*b*. An angle between a slant edge of the first conical surface 20*a* and an axis 2α of the needle 2 is greater than an angle between a slant edge of the second conical surface 20*b* and the axis 2α of the needle 2. An intersection line 21*a* of the first conical surface 20*a* and the second conical surface 20*b* is a circle that is perpendicular to the axis 2α, and functions as the seat portion 10.

A part of the needle 2 which is adjacent to a tip end side of the seat portion 10 is a cone having a diameter reduced toward a tip end side of the cone in the axial direction.

When the seat portion 10 is seated on the seat surface 9, an end of the needle 2 protrudes to a position in the sack chamber 12 where the end of the needle 2 is opposite to the injection-port inlet 11*a* in the radial direction. In this case, the end of the needle 2 is an apex of the first conical surface 20*a*.

Figure 4A:
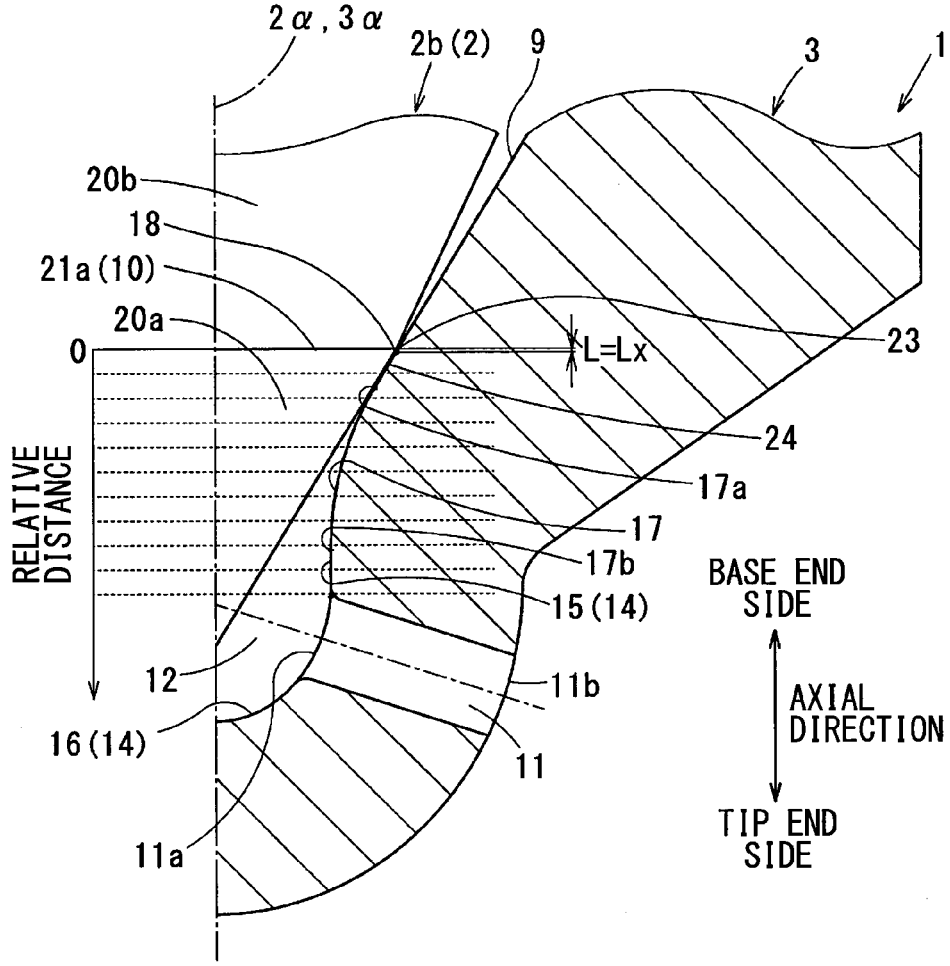
FIG. 4A is a diagram showing a relative distance in a case where a lifting amount is in a range of a seat throttle state, according to the first embodiment.

As shown in FIG. 4A, when the seat portion 10 is removed from the seat surface 9, an injection flow of the fuel from a first gap 23 interposed between the seat surface 9 and the seat portion 10 to an outlet 11*b* of the injection port 11 is generated, and the fuel is injected through the injection port 11. The outlet 11*b* of the injection port 11 is referred to as an injection-port outlet 11*b*. A minimum throttle portion of the injection flow having a flow-passage area which is minimum varies according to an axial distance between the seat portion 10 and the seat position 18 in the axial direction toward the tip end side of the seat portion 10. In this case, the axial distance is a lifting amount L of the needle 2.

When the lifting amount L is significantly small after the seat portion 10 is removed from the seat surface 9, the first gap 23 becomes the minimum throttle portion. In this case, a state that the injection flow is throttled by the first gap 23 is referred to as a seat throttle state. When the lifting amount L becomes larger, a second gap 24 interposed between the seat surface 9 and the first conical surface 20*a* becomes the minimum throttle portion. In this case, a state that the injection flow is throttled by the second gap 24 is referred to as an apex throttle state. When the lifting amount L reaches a reference Lc shown in FIG. 9, the injection port 11 becomes the minimum throttle portion. In this case, a state that the injection flow is throttled by the injection port 11 is referred to as an injection-port throttle state.

In addition, the lifting amount L corresponds to a dimension of the first gap 23.

According to the nozzle 1 of the first embodiment, in the cross section x including the axis 3α of the nozzle body 3, the seat surface 9 and the side surface 15 are both smoothly connected to the arc of the circle inscribing both the seat surface 9 and the side surface 15. Further, a part of the needle 2 which is adjacent to the tip end side of the seat portion 10 is a cone having a diameter reduced toward the tip end side of the cone in the axial direction.

Thus, there is no corner on the seat surface 9 or the side surface 15, and the seat surface 9 and the side surface 15 form one curved surface. Therefore, a generation of a separation of the injection flow of the fuel from the first gap 23 interposed between the seat surface 9 and the seat portion 10 to the injection-port outlet 11*b* is reduced. Further, a portion that a flow-passage area of the fuel from the first gap 23 to the injection-port inlet 11*a* is sharply enlarged does not exist. Since a cavitation generated in the sack chamber 12 can be reduced, even when an injection quantity is significantly small such that the injection port 11 does not throttle the injection flow, that is, even when the lifting amount L is a significantly small value in the seat throttle state or the apex throttle state, a flow coefficient of the injection flow is improved and a penetration of a spray of the fuel can be maintained.

Effects of the nozzle 1 of the first embodiment will be described by comparing with a first conventional nozzle 1A and a second conventional nozzle 1B. In addition, the substantially same parts or components as those in the first embodiment are indicated with the same reference numerals and the same descriptions will not be reiterated.

Figure 5:
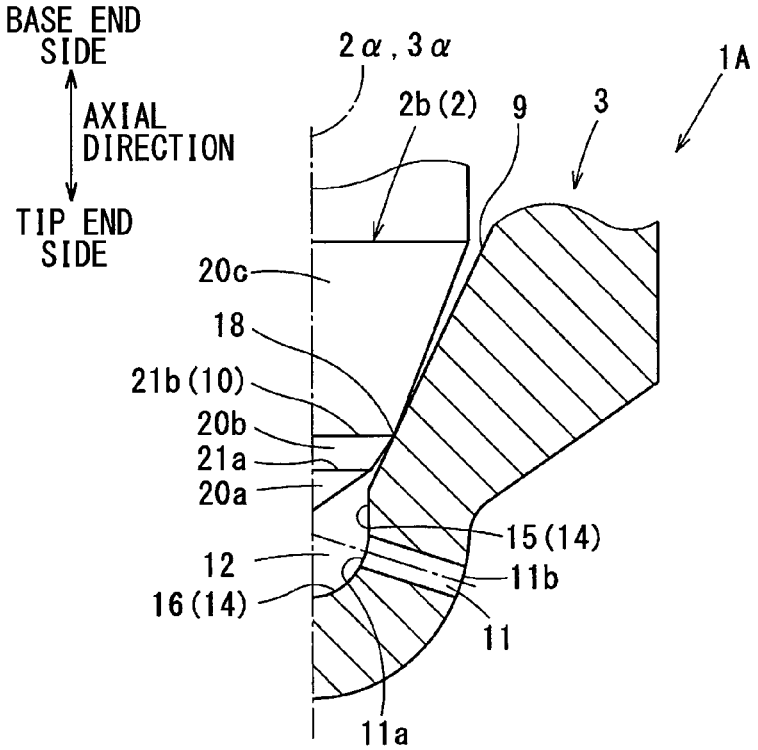
FIG. 5 is a diagram showing a part of a first conventional nozzle.

As shown in FIG. 5, the outer-peripheral surface of the end portion 2*b* includes the first conical surface 20*a*, the second conical surface 20*b*, and a third conical surface 20*c*. The first conical surface 20*a* is placed at a position of the tip end side of the second conical surface 20*b* and is connected with the second conical surface 20*b*. The second conical surface 20*b* is placed at a position of a tip end side of the third conical surface 20*c* and is connected with the third conical surface 20*c*. The angle between the slant edge of the first conical surface 20*a* and the axis 2α of the needle 2 is greater than the angle between the slant edge of the second conical surface 20*b* and the axis 2α of the needle 2. The angle between the slant edge of the second conical surface 20*b* and the axis 2α of the needle 2 is greater than an angle between a slant edge of the third conical surface 20*c* and the axis 2α of the needle 2.

In the sack chamber 12 of the first conventional nozzle 1A, the side surface 15 and the seat surface 9 is not smoothly connected to each other. Specifically, a corner is directly disposed between the side surface 15 and the seat surface 9 such that the side surface 15 crosses the seat surface 9. The bottom surface 16 has the same shape as the nozzle 1 which is a hemisphere surface and protrudes toward the tip end side in the axial direction, and the injection-port inlet 11*a* has the same shape as the nozzle 1 which is provided to span the side surface 15 and the bottom surface 16.

Figure 6:
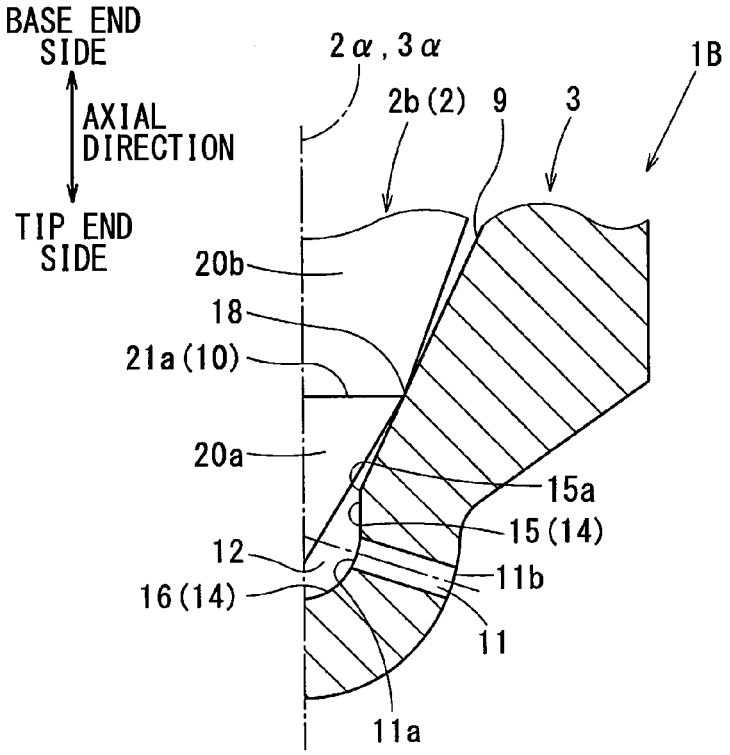
FIG. 6 is a diagram showing a part of a second conventional nozzle.

As shown in FIG. 6, in the second conventional nozzle 1B, the end portion 2*b* has the same shape as the nozzle 1, and the sack chamber 12 has the same shape as the first conventional nozzle 1A.

In addition, in the nozzle 1, the first conventional nozzle 1A, and the second conventional nozzle 1B, a diameter of the seat portion 10, a diameter of the side surface 15, and a seat angle are set to the same values, respectively. The seat angle is an angle between a slant edge of a truncated cone surface placed at a position of a base end side of the seat portion 10 and the axis 2α of the needle 2. The truncated cone surface is the second conical surface 20*b* of the nozzle 1, the third conical surface 20*c* of the first conventional nozzle 1A, or the second conical surface 20*b* of the second conventional nozzle 1B.

Figure 4B:
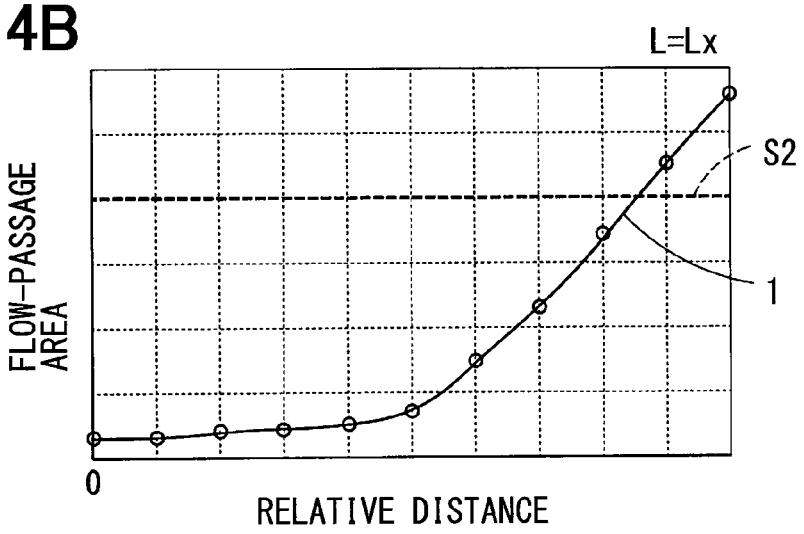
FIG. 4B is a diagram showing a relationship between a flow-passage area and the relative distance in a case where the lifting amount is in the range of the seat throttle state, according to the first embodiment.
Figure 7:
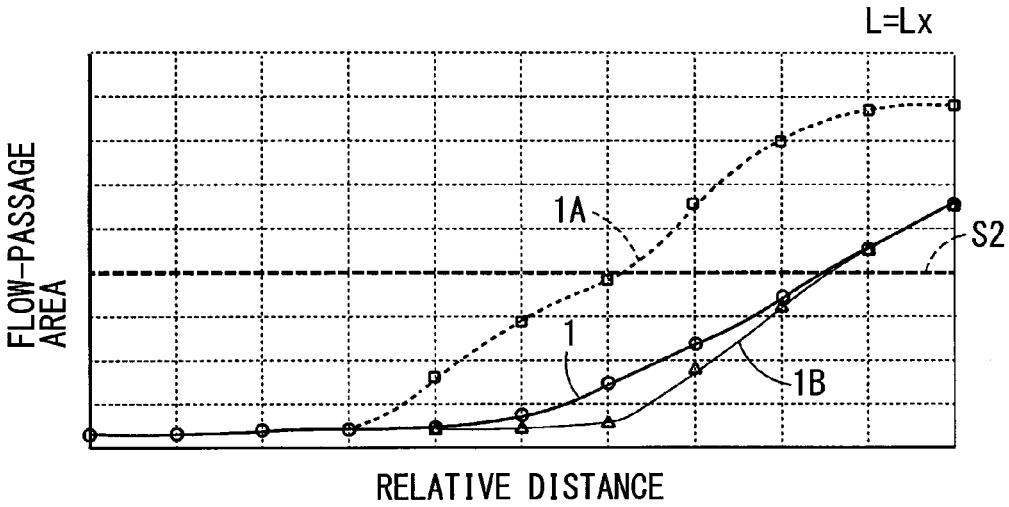
FIG. 7 is a diagram showing relationships between the relative distance and the flow-passage area in the fuel injection nozzle, a first conventional nozzle, and a second conventional nozzle, respectively, according to the first embodiment.

As shown in FIGS. 4B and 7, relationships between a relative distance and the flow-passage area, in the nozzle 1, the first conventional nozzle 1A, and the second conventional nozzle 1B, respectively. In this case, the relative distance is a distance relative to the seat position 18 toward the injection port 11 in the axial direction, and the lifting amount L is a predetermined value Lx that the injection flow is throttle in the seat throttle state.

Bold dashed lines indicate a total sum of sectional areas of the flow passages of plural injection ports 11. An intermediate distance between the seat position 18 and the injection port 11*a* in the nozzle 1 is substantially equal to the intermediate distance in the second conventional nozzle 1B, and the intermediate distance in the first conventional nozzle 1A is less than both the intermediate distance in the nozzle 1 and the intermediate distance in the second conventional nozzle 1B.

Figure 8:
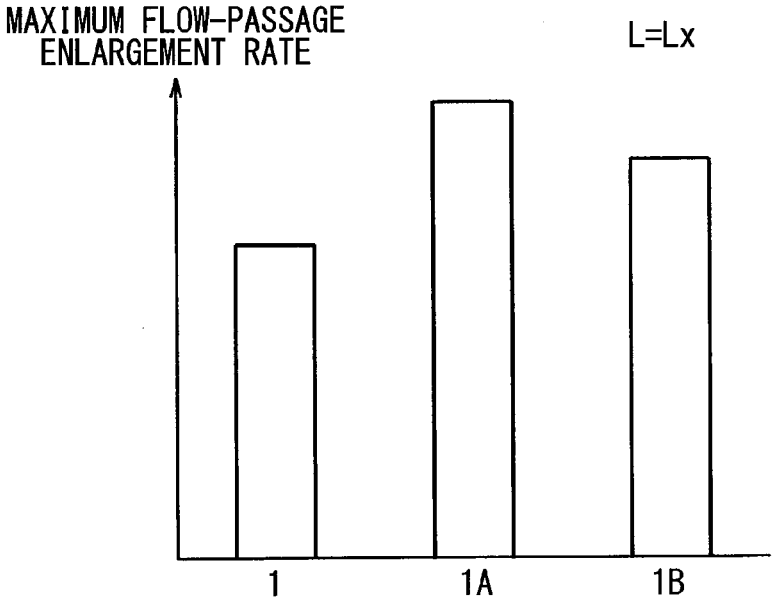
FIG. 8 is a diagram showing a maximum flow-passage enlargement rate of the fuel injection nozzle, a maximum flow-passage enlargement rate of the first conventional nozzle, and a maximum flow-passage enlargement rate of the second conventional nozzle, when the lifting amount is in the range of the seat throttle state, according to the first embodiment.

FIG. 8 is a diagram showing a maximum flow-passage enlargement rate of the nozzle 1, a maximum flow-passage enlargement rate of the first conventional nozzle 1A, and a maximum flow-passage enlargement rate of the second conventional nozzle 1B, based on the relationships shown in FIG. 7, when the lifting amount L is the predetermined value Lx.

Figure 9:
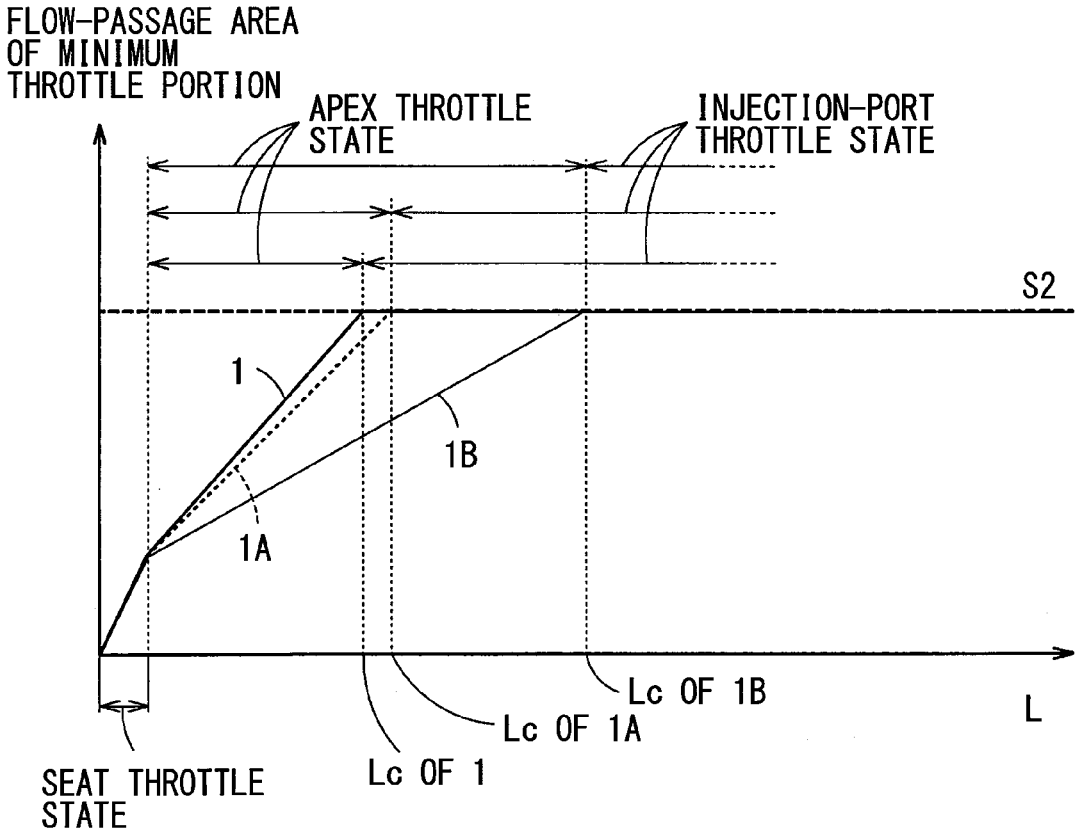
FIG. 9 is a diagram showing relationships between the flow-passage area of the minimum throttle portion and the lifting amount L in the fuel injection nozzle, the first conventional nozzle, and the second conventional nozzle, respectively, according to the first embodiment.

FIG. 9 is a diagram showing relationships between the flow-passage area of the minimum throttle portion and the lifting amount L in the nozzle 1, the first conventional nozzle 1A, and the second conventional nozzle 1B, respectively.

According to the relationships shown in FIG. 7, the flow-passage area of the nozzle 1 has an increasing rate less than that of the first conventional nozzle 1A or the second conventional nozzle 1B. Further, according to the maximum flow-passage enlargement rates shown in FIG. 8, the nozzle 1 has a value less than that of the first conventional nozzle 1A or the second conventional nozzle 1B. Thus, since an enlargement rate of the flow passage of the nozzle 1 is less than that of the first conventional nozzle 1A or the second conventional nozzle 1B, a generation of a cavitation can be reduced.

According to the relationships shown in FIG. 9, when the lifting amount L is in a range of the apex throttle state, the upstream end 17*a* of the sack portion 17 becomes the minimum throttle portion in the nozzle 1 as shown in FIG. 4A, and an upstream end 15*a* of the side surface 15 becomes the minimum throttle portion in the second conventional nozzle 1B as shown in FIG. 6. Since the upstream end 17*a* has a diameter greater than a diameter of the upstream end 15*a*, a first time from a start of the apex throttle state to a start of the injection-port throttle state in the nozzle 1 is significantly less than the first time in the second conventional nozzle 1B.

Since the end portion 2*b* of the nozzle 1 as shown in FIG. 4A is inserted into the sack chamber 12 more deeply than the end portion 2*b* of the first conventional nozzle 1A as shown in FIG. 5, a capacity of the sack chamber 12 can be readily reduced. Thus, a second time for increasing a fuel pressure in the sack chamber 12 in the nozzle 1 is reduced more readily than the second time in the first conventional nozzle 1A. Therefore, the first time in the nozzle 1 is reduced more readily than the first time in the first conventional nozzle 1A.

When the lifting amount L is in the range of the apex throttle state, since a fuel flow throttled by the second gap 24 flows into the sack chamber 12, the cavitation is readily generated in the sack chamber 12. Thus, it is preferable that a third time of the apex throttle state is short to maintain the penetration of the spray by restraining a deterioration of the flow coefficient.

Therefore, the nozzle 1 has a configuration which reduces the generation of the cavitation and restrains the deterioration of the flow coefficient with respect to the first conventional nozzle 1A and the second conventional nozzle 1B.

[Second Embodiment]

Figure 10:
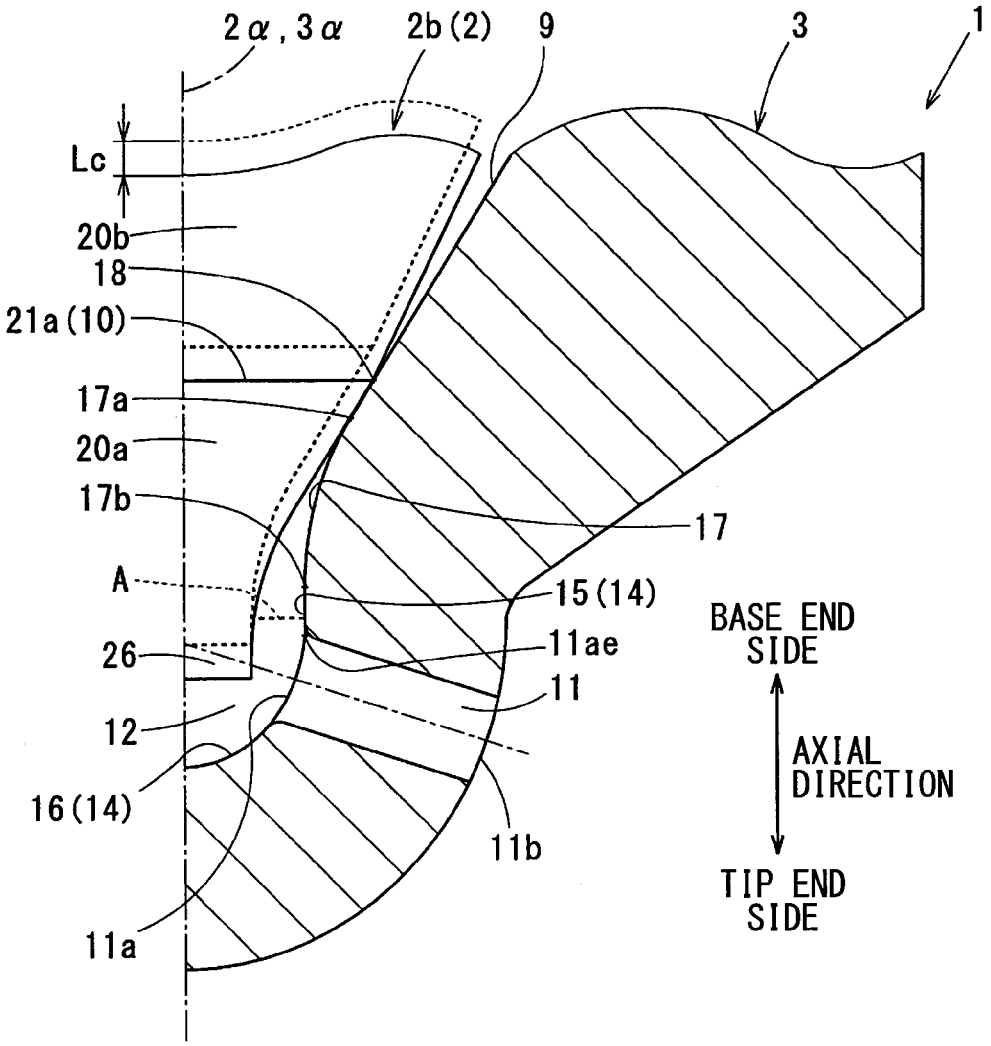
FIG. 10 is a diagram showing a part of the fuel injection nozzle according to a second embodiment of the present disclosure.

As shown in FIG. 10, in the nozzle 1 according to a second embodiment, an end portion of the needle 2 in the axial direction is a columnar portion 26 having a cylindrical surface parallel to the axis 2α. The cylindrical surface is an outer-peripheral surface of the needle 2. The needle 2 has an outer-peripheral diameter reduced from the seat portion 10 toward the columnar portion 26. The first conical surface 20*a* and the outer-peripheral surface of the columnar portion 26 are smoothly connected to each other. The sack surface 14 has a shape as the same as that of the first embodiment.

The outer-peripheral surface of the columnar portion 26 is opposite to the sack surface 14 in the radial direction to form a passage having a cylindrical shape and having a cross section A which is a ring shape. In this case, the passage is for the injection flow, that is, the injection flow flows through the passage. In a predetermined period where the nozzle 1 moves from the apex throttle state to the injection-port throttle state, a throttle area S1 of the cross section A placed at a base end 11*ae* of the injection-port inlet 11*a* in the axial direction is equal to a total area S2 of the flow passages of the injection ports 11. In this case, specifically, the lifting amount L is in a range from Lc−m to Lc+n, and m and n are positive values which are predetermined.

In a valve-opening operation of the nozzle 1, when the seat portion 10 is separated from the seat surface 9, the throttle area S1 becomes equal to the total area S2 in a period from a time point that the lifting amount L reaches Lc−m to a time point that the lifting amount L reaches Lc+n. In addition, m is set to be greater than zero and less than the reference Lc, and n is set to be greater than zero and less than Lmax. In this case, Lmax is the maximum of the lifting amount L.

Thus, the nozzle 1 of the present embodiment is as the same as the nozzle 1 of the first embodiment that the cavitation generated in the sack chamber 12 is reduced and the penetration of the spray can be maintained in a small lifting amount. According the nozzle 1 of the present embodiment, since the throttle area S1 is equal to the total area S2, the flow of the fuel introduced by the sack surface 14 adjacent to the injection-port inlet 11*a* and the flow of the fuel flowing through the injection port 11 have the same flow-passage sectional area.

Figure 11:
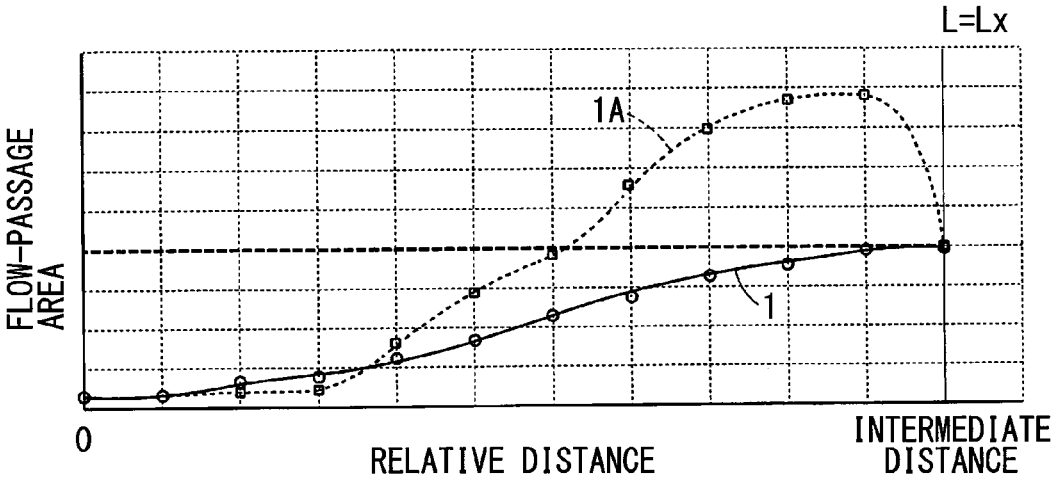
FIG. 11 is a diagram showing relationships between the axial distance and the flow-passages area in the fuel injection nozzle and the first conventional nozzle, when the lifting amount is in the range of the seat throttle state, according to the second embodiment.

Thus, even when the fuel flows from the sack chamber 12 into the injection port 11 in a case where the lifting amount is small, the flow-passage sectional area is not changed as shown in FIG. 11, and the penetration of the spray can be maintained by restraining the deterioration of the flow coefficient.

FIG. 11 is a diagram showing relationships between the relative distance and the flow-passage area in the nozzle 1 and the first conventional nozzle 1A, respectively.

Other Embodiment

A configuration of the nozzle 1 is not limited to the above embodiments, various modifications can be applied.

According to the above embodiments, in the nozzle 1, the side surface 15 of the sack surface 14 is a cylindrical shape, and the bottom surface 16 is a hemisphere surface that protrudes toward the tip end side in the axial direction. However, the side surface 15 may be a conical surface having a sharper slope than the seat surface 9, and the bottom surface 16 may be a conical surface.

According to the second embodiment, in the nozzle 1, the outer-peripheral surface of the columnar portion 26 is a cylindrical surface. However, the outer-peripheral surface of the columnar portion 26 may be a prismatic surface.

What is claimed is:

1. A fuel injection nozzle comprising:

a nozzle body being a cylindrical shape;

a needle received in the nozzle body, the needle being slidable relative to an inner periphery of the nozzle body in an axial direction of the nozzle body, wherein the inner periphery of the nozzle body includes a seat surface, the needle includes a seat portion, the seat portion is removed from or seated on the seat surface to start or stop a fuel injection using an injection port disposed at a tip end side of the seat surface in the axial direction, the seat surface is a tapered shape, a diameter of the seat surface is reduced toward the tip end side of the seat surface in the axial direction, a sack chamber is disposed at a position adjacent to the tip end side of the seat surface, the sack chamber includes an inlet of the injection port, a sack surface defining the sack chamber includes a side surface and a bottom surface, the side surface has a sharper slope than the seat surface and is coaxial with the seat surface, the bottom surface is a curved shape and covers the sack chamber at a tip end side of the side surface in the axial direction, the side surface and the bottom surface are connected to each other, a part of the needle which is adjacent to a tip end side of the seat portion is a cone having a diameter reduced toward a tip end side of the cone in the axial direction, in a cross section including an axis of the nozzle body and an axis of the injection port, the seat surface and the side surface from one curved surface, and when the seat portion is seated on the seat surface, an end of the needle protrudes to a position in the sack chamber where the end of the needle is opposite to the inlet in a radial direction of the nozzle body.

2. A fuel injection nozzle comprising:

a nozzle body being a cylindrical shape;

a needle received in the nozzle body, the needle being slidable relative to an inner periphery of the nozzle body in an axial direction of the nozzle body, wherein the inner periphery of the nozzle body includes a seat surface, the needle includes a seat portion, the seat portion is removed from or seated on the seat surface to start or stop a fuel injection using an injection port disposed at a tip end side of the seat surface in the axial direction, a minimum throttle portion of an injection flow flowing from a gap interposed between the seat surface and the seat portion to an outlet of the injection port has a flow-passage area which is minimum, when a lifting amount of the needle becomes a first predetermined distance, the minimum throttle portion becomes the injection port, the seat surface is a tapered shape, a diameter of the seat surface is reduced toward the tip end side of the seat surface in the axial direction, a sack chamber is disposed at a position adjacent to the tip end side of the seat surface, the sack chamber includes an inlet of the injection port, a sack surface defining the sack chamber includes a side surface and a bottom surface, the side surface has a sharper slope than the seat surface and is coaxial with the seat surface, the bottom surface is a curved shape and covers the sack chamber at a tip end side of the side surface in the axial direction, the side surface and the bottom surface are smoothly connected to each other, in a cross section including an axis of the nozzle body, the side surface and the seat surface are both smoothly connected to an arc of a circle inscribing both the side surface and the seat surface, the needle further includes a columnar portion disposed at a tip end side of the seat portion in the axial direction and having an outer-peripheral surface parallel to an axis of the needle, the needle has an outer-peripheral diameter reduced from the seat portion toward the columnar portion, the seat portion and the outer-peripheral surface of the columnar portion are smoothly connected to each other, the outer-peripheral surface of the columnar portion is opposite to the sack surface in a radial direction of the nozzle body to define a passage of an injection flow of a fuel, the passage having a cylindrical shape and having a cross section that is a ring shape, a first area of the cross section placed at a base end of the inlet of the injection port in the axial direction is equal to a second area that is a total sum of the flow passages of a plurality of the injection ports, when the lifting amount is in a range from the first predetermined distance minus a second predetermined distance to the first predetermined distance plus a third predetermined distance, wherein the second predetermined distance and the third predetermined are positive distances, and the second predetermined distance is less than the first predetermined distance, and the third predetermined distance is less than a maximum of the lifting amount.

3. The fuel injection nozzle of claim 1, wherein the seat surface and the side surface are smoothly connected, such that the seat surface and the side surface form one curved surface without a corner on the seat surface or on the side surface.

4. The fuel injection nozzle of claim 2, wherein the seat surface and the side surface are smoothly connected, such that the seat surface and the side surface form one curved surface without a corner on the seat surface or on the side surface.

5. The fuel injection nozzle of claim 1, wherein a gap between the seat portion and the seat surface is configured to be a flow-passage area of fuel to the inlet of the injection port, such that the flow-passage area does not include a sharp enlargement.

6. The fuel injection nozzle of claim 2, wherein the flow-passage area does not include a sharp enlargement.

7. The fuel injection nozzle of claim 1, wherein the seat surface has a fourth predetermined distance between a seat position where the seat portion is seated on the seat surface and an upstream end of a sack portion of the side surface, the fourth predetermined distance being configured to provide strength to the seat surface when the seat portion is seated on the seat surface.

8. The fuel injection nozzle of claim 2, wherein the seat surface has a fourth predetermined distance between a seat position where the seat portion is seated on the seat surface and an upstream end of a sack portion of the side surface, the fourth predetermined distance being configured to provide strength to the seat surface when the seat portion is seated on the seat surface.

9. The fuel injection nozzle of claim 1, wherein the side surface has a fifth predetermined distance between a downstream end of a sack portion of the side surface and the inlet of the injection port, the fifth predetermined distance being configured to reduce cavitation generated in the injection port.

10. The fuel injection nozzle of claim 2, wherein the side surface has a fifth predetermined distance between a downstream end of a sack portion of the side surface and the inlet of the injection port, the fifth predetermined distance being configured to reduce cavitation generated in the injection port.

11. The fuel injection nozzle of claim 2, wherein when the seat portion is separated from the seat surface, the first area becomes equal to the second area in a period from a first time point when the lifting amount reaches the first predetermined distance minus the second predetermined distance to a second time point when the lifting amount reaches the first predetermined distance plus the third predetermined distance.

12. The fuel injection nozzle of claim 2, wherein the second predetermined distance is greater than zero, and the third predetermined distance is greater than zero.

13. The fuel injection nozzle of claim 2, wherein the columnar portion of the needle is parallel to the sack surface in a radial direction of the nozzle body, such that the passage in the ring shape has a constant cross-sectional area between the columnar portion of the needle parallel to the sack surface and the sack surface parallel to the columnar portion of the needle.

* * * * *